United States Patent [19]

Matyas et al.

[11] Patent Number: 5,026,229

[45] Date of Patent: Jun. 25, 1991

[54] COLLAPSIBLE HITCH

[75] Inventors: Tibor Matyas, Lawrenceville, Ga.; Richard J. Vanderlinden, Fletcher, N.C.

[73] Assignee: Trinity Industries, Inc., Dallas, Tex.

[21] Appl. No.: 451,214

[22] Filed: Dec. 15, 1989

[51] Int. Cl.[5] ..... B60P 3/06

[52] U.S. Cl. ..... 410/60; 410/58

[58] Field of Search ..... 410/52, 56, 58, 59, 410/60, 61, 62, 63, 64

[56] References Cited

U.S. PATENT DOCUMENTS

| | | | |
|---|---|---|---|
| 3,164,346 | 1/1965 | Bateson | 410/62 X |
| 3,190,595 | 6/1965 | Ferris | 410/60 |
| 3,358,954 | 12/1967 | Smith et al. | 410/59 |
| 3,497,169 | 2/1970 | Enochian | 410/60 |
| 3,536,282 | 10/1970 | Ferris | 410/58 |
| 4,397,594 | 8/1983 | Hammonds et al. | 410/59 |

*Primary Examiner*—Frank E. Werner
*Assistant Examiner*—James Eller
*Attorney, Agent, or Firm*—Myers & Assoc., Ltd.

[57] ABSTRACT

This invention relates to a low profile collapsible hitch for use in securing a container or a trailer on a transport carrier having a vertical strut assembly having an upper end for supporting a king pin receiving plate and a lower end pivotally secured by a pivot mount assembly secured to a deck of the transport carrier, a diagonally extending strut assembly having an upper end pivotally connected to the upper end of the vertical strut assembly and having a lower end pivotally connected to a locking hook assembly which is slidable along the surface of the deck, an anchor for limiting the movement of the diagonal strut assembly during erection of said apparatus, a pair of lock blocks engageable by the locking hook assembly for locking the vertical strut assembly in erected position, the anchor and the lock blocks defining therebetween a path for reciprocal movement of the lower end of the diagonally extending support strut assembly, and release members associated with each of the lock blocks and cooperatively engageable with the locking hook assembly for collapsing the load supporting apparatus, and a retarding device coupled to the locking hook assembly for retarding the collapse of the apparatus.

8 Claims, 2 Drawing Sheets

COLLAPSIBLE HITCH

BACKGROUND OF THE INVENTION

1. Field of the Invention

This invention relates to a collapsible support for containers, semi-trailers, and the like, and particularly to a collapsible support or hitch having a supporting mounting plate or "fifth wheel" designed to engage a king pin or the like of the containers, such as highway semi-trailers which are loaded upon railway cars for transport, the collapsible support having a low profile when it is in the storage position to accommodate the passage thereover of vehicles having low ground clearance, and to allow the stowage of cargo containers on top of the collapsed hitch.

2. Description of the Prior Art

Although many improvements have been made generally in trailer hitches, the primary concern in the prior art is with hitches provided with collapsible supports which present a low profile on a deck of a carrier vehicle, such as described in U.S. Pat. No. 3,497,169, describing a "LOW-PROFILE HITCH FOR ROAD SEMI-TRAILER". This known hitch requires the use of a box-like rigid base providing a structure for a slide assembly and a cushion assembly.

SUMMARY OF THE INVENTION

In the present invention, to simplify the construction and installation of the collapsible hitch, certain components of the collapsible hitch are mounted directly on the deck plate of a transport carrier, the components being interconnected with a number of pivotal members provided for moving a king pin receiving plate from a collapsed to an erected position. A pair of pivot mounts are spaced from each other and secured directly to the deck of the vehicle carrier and pivotally connect one end of a vertically extending strut assembly having the other end coupled to the king pin receiving plate. One end of a diagonal strut assembly is pivotally connected intermediate to the ends of the vertical strut assembly, while the other end of the diagonal strut assembly is pivotally connected to a locking hook assembly glidable along the surface of the deck plate, the diagonal strut assembly having a pair of elongated spaced members having inner surfaces guided by a pair of spaced anchors secured to the deck plate, the exterior surfaces of the spaced members being guided by a pair of spaced locking blocks secured to the deck plate, the locking hook assembly having a pair of spaced locking hooks glidable over spaced locking blocks to lock the hitch in erected position. The locking hook assembly is secured to a retarder assembly which resists the collapse of the hitch when a release mechanism trips the locking hooks to a release position, the retarder assembly being secured to the deck plate. The undersurface of the king pin receiving plate has a series of downwardly extending flanges arranged to clear the diagonal strut assembly and the vertically extending strut assembly so that the king pin receiving plate rests on the collapsed vertical strut assembly. The locking hook assembly is pivotally traversed by a pivot shaft which is adapted to engage with the two anchors to lock the hitch in the erected position.

It is an important object of the present invention to secure the stationary components of the collapsible hitch directly to the deck plate of a transport carrier such as a railway car or a ship.

Another important object of the invention is concerned with a proper arrangement of the various stationary components on the deck plate so that they function also as guides for the moveable components of the collapsible hitch.

Another object of the invention is to provide a low-profile hitch of the type described wherein the height of the collapsed hitch is no more than about 6 inches above the deck plate of the vehicle carrier.

A still further object of the invention is to provide, in a low-profile hitch of the type set forth, a cover mounted on a retarder assembly and a locking hook assembly for protection thereof when the hitch is in its storage position.

A still further object of the invention is to provide a safety indicator associated with one of the moveable components to visably show the properly and safely erected position of the hitch.

A still further object of the invention is to utilize the surface of a deck plate to provide a gliding function for one or more of the moveable components comprising the collapsible hitch.

Other objects and advantages of the invention will become apparent from the disclosure in the drawings.

DESCRIPTION OF THE PREFERRED EMBODIMENT

Figures 1, 1A, 2:
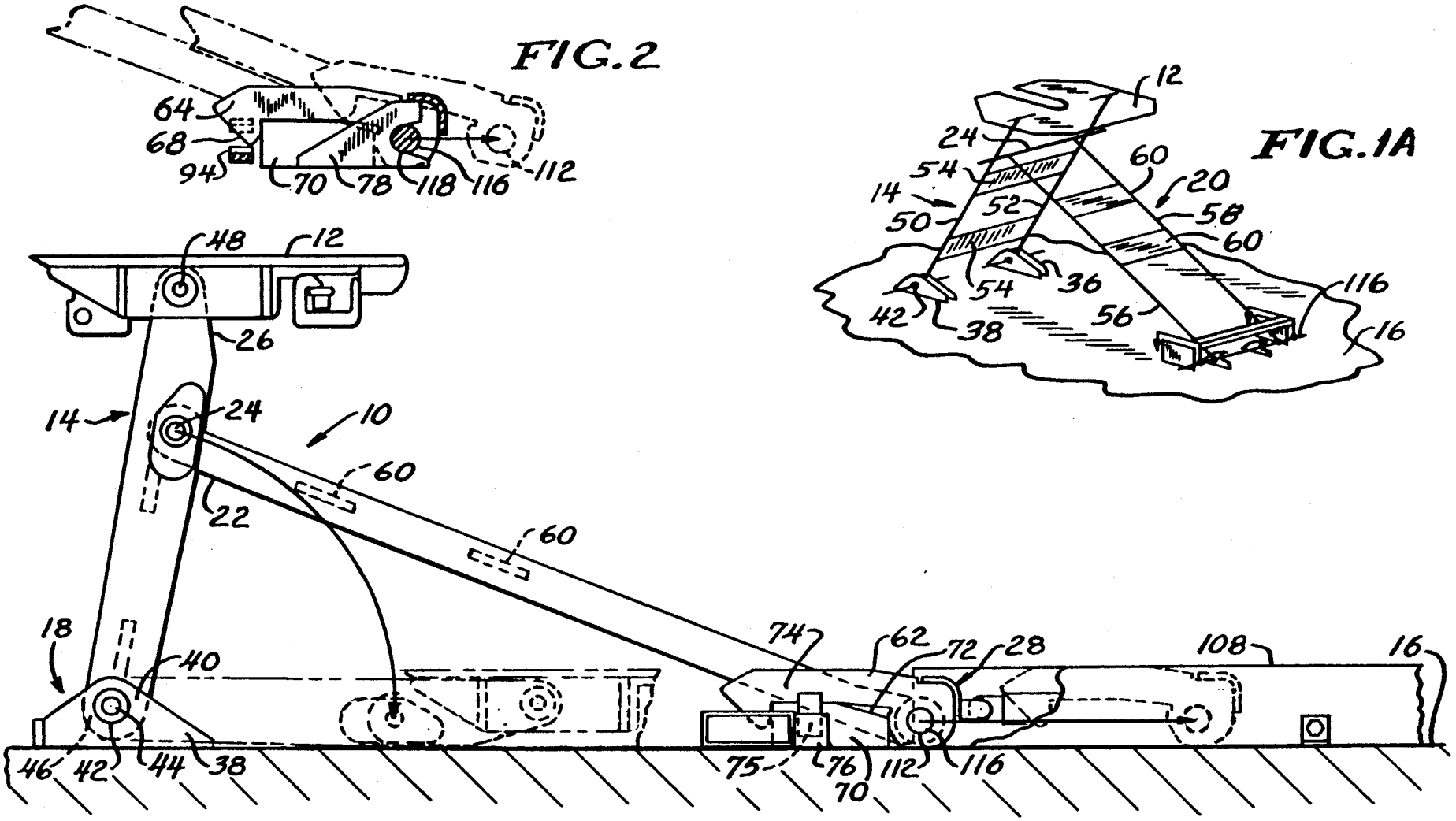
FIG. 1 is a side elevation view of a collapsible hitch shown by solid lines in the erected position and in phantom lines in the collapsed position.
FIG. 1A is a diagramatic sketch of the collapsible hitch in the erected position to illustrate the construction of vertical extending and diagonal strut assemblies.
FIG. 2 is a partial cross-sectional view along the lines 2—2 of the collapsible hitch shown in FIG. 3.

Referring to FIG. 1, a collapsible hitch 10 is shown in erected position, as indicated by solid lines. The phantom lines show the hitch in the collapsed position. A king pin receiving plate 12 is mounted on one end of a vertical strut assembly 14 having the other end thereof secured to a deck 16 by means of pivot mount assembly 18. The vertical strut assembly 14 is maintained in its erected position by a diagonal strut assembly 20 which has one end 22 pivotally connected by a pivot pin 24 to an upper portion 26 of the vertical strut assembly 14, the other end of the diagonal strut assembly 20 being coupled to a locking hook assembly 28 which, in turn, is pivotally coupled by a pivot pin 21 to a retarder cylinder assembly 30 pivotally secured by a pivot pin 32 mounted in a pivot block 34 secured to the deck 16.

Figure 3:
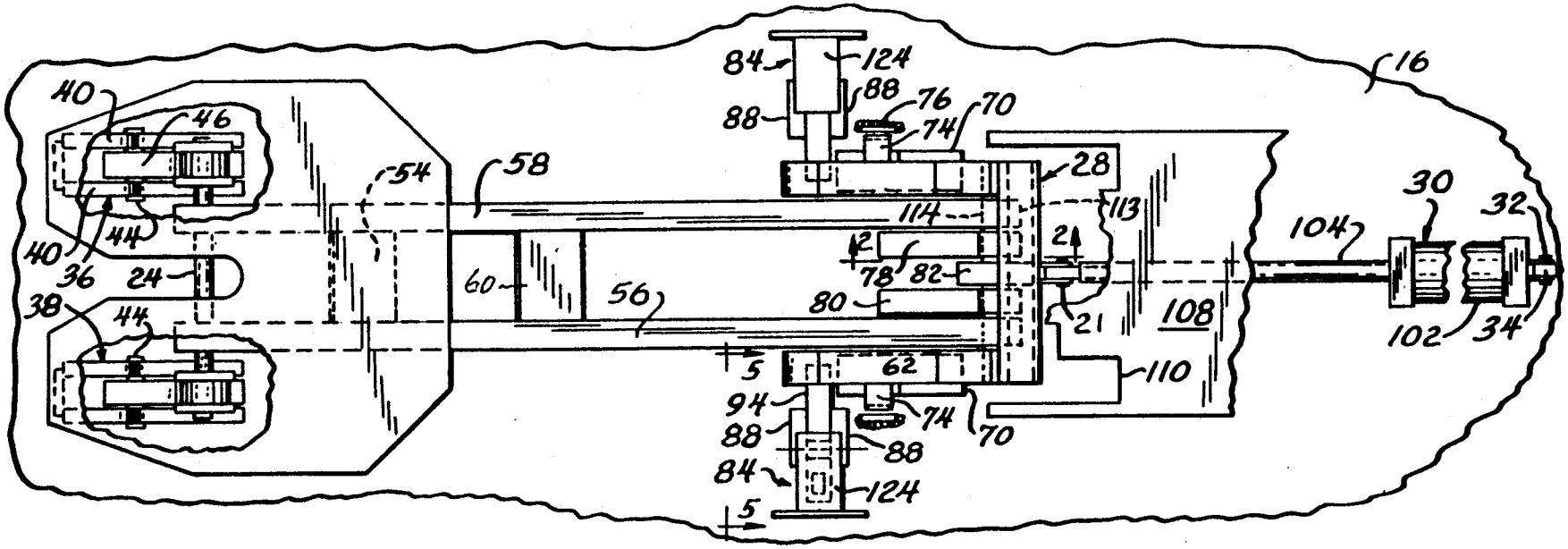
FIG. 3 is a plan view of the collapsible hitch in its erected position.

The pivot mount assembly 18 comprises a pair of spaced pivot blocks 36 and 38, as best viewed in FIGS. 3 and 1A, each of the pivot blocks having a pair of spaced ears 40 having bores 42 for admitting a pivot shaft 44 which pivotally supports lower end 46 of the vertical strut assembly 14. The upper portion 26 of the vertical strut assembly 14 pivotally secures the king pin receiving plate 12 by means of a pivot pin 48.

The vertical strut assembly 14 has a pair of spaced strut members 50 and 52 which are maintained in their spaced relationship by transverse members 54. The diagonal strut assembly 20 has a pair of longitudinally extending spaced strut members 56 and 58 which are maintained in their spaced relationship by transverse members 60 which are properly situated along the strut members 56 and 58 so as not to interfere with the positioning of the king pin receiving plate 12 in the collapsed position to obtain a low-profile on the surface of the deck 16.

The locking hook assembly 28 has a pair of spaced hooks 62 and 64 rigidly secured by a bracket 66. Each of the hooks, such as hook 64, has a tooth 68 which is adapted to glide over and engage a lock block 70 which is secured to the deck 16. Each of the lock blocks 70 is provided with a sloping surface 72 to facilitate the initial movement of the hook 64 over the lock block 70. Each of the hooks 62 and 64 is provided with a protuberance 74 which extends downwardly along the lateral wall of the hook. The lower portion 75 of the protuberance 74, as best seen in FIG. 1, is painted with a bright color so that, when the hooks 62 and 64 are in proper locking arrangement with the respective lock blocks 70, the painted portion 75 of the protuberance 74, namely, a safety flag, will not be seen because the painted portion will be obscured or shielded by an adjacent safety flag cover 76 secured to the deck 16. If the hooks 62 and 64 do not properly engage with their respective locking blocks 70, the brightly pointed flag 75 will be visible and warn the attendant of incomplete erection of the hitch. Located between the spaced lock blocks 70 is a pair of spaced anchors 78 and 79 secured to the deck plate 16. Extending between the spaced anchors 78 and 80 is a torsion spring 82 connected to the bracket 66 and interacting with the surface of the deck 16 to apply a counter-clockwise biasing action to the locking hook assembly 28 to urge the hooks 62 and 64 against the lock blocks 70.

Figure 5:
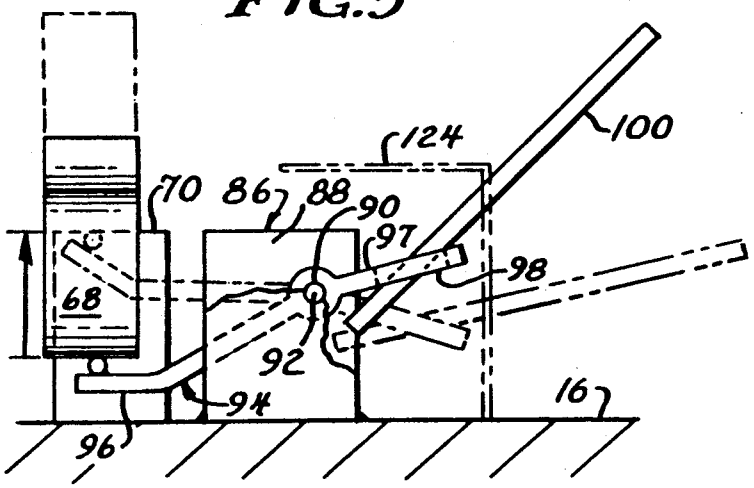
FIG. 5 is an enlarged view of a release mechanism for releasing the hitch from its erected position.

For collapsing the hitch 10, there is provided, associated with each side of the lock blocks 70, a release mechanism 84 which comprises, as best viewed in FIG. 5, a pivot block 86 having a pair of spaced vertically extending walls 88 provided with bores 90 for accepting a pivot shaft 92 pivotally supporting a release lever 94 having one end 96 adapted to engage the tooth 68 of the hooks 62 and 64, as shown in FIG. 2. Other end 97 of the release lever 94 forms a bracket 98 which is adapted to be engaged by an end of a release bar 100. By applying a downward force to the free end of the release bar 100, the release lever 94 will be pivoted clockwise and upset the locking hook assembly 28 to thereby collapse the hitch 10 into a low-profile position on the surface of the deck 16. The release mechanism 84 is protected by a housing 126 to prevent accidental tripping of the locking hook assembly 28.

The retarder cylinder assembly 30 comprises a cylinder 102 having one end secured by the pin 32 and the pivot block 34 to the deck 16, and the other end of the cylinder having a slidably movable piston rod 104 having an exterior end secured by the pivot pin 21 to the bracket 66 of the locking hook assembly 28. As partly shown in FIG. 3, the retarder cylinder assembly 30 is protected by a cover 108 which has a pair of spaced cut-outs 110 which provide clearance for the hooks 62 and 64 when they are released from engagement with the lock blocks 70.

The hooks 62 and 64 are provided with bores 112 and ends 113 of the strut members 56 and 58 are provided with a complementary set of bores 114 transversed by a pivot shaft 116. Thus, the pivot shaft 116 pivotally interconnects the locking hook assembly 28 together with the diagonal strut assembly 20. The pivot shaft 116 also functions as a stop in conjunction with the anchors 78 and 80 to prevent the hitch 10 from over-reaching a properly erected height. As shown in FIG. 2, the anchor 78 has an arcuate seat 118 for stopping further movement of the pivot shaft 116 towards the left.

Figure 4:
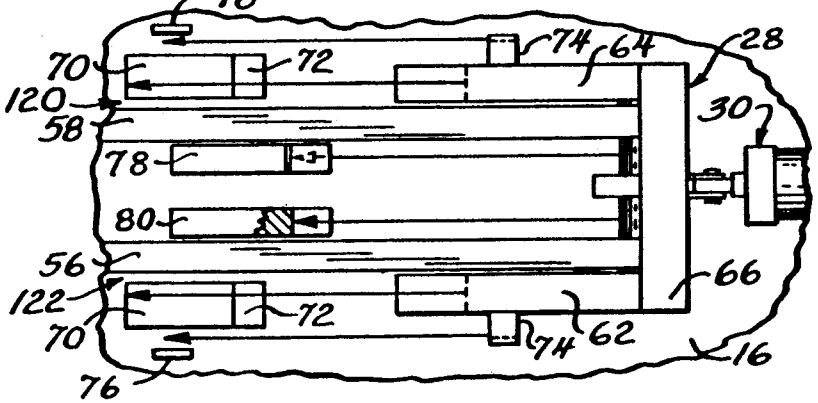
FIG. 4 is a partial plan view of the hitch showing the location of various components in the collapsed position of the hitch.

As best viewed in FIGS. 3 and 4, the lock blocks 70 and the anchors 78 and 80 are so arranged to provide therebetween paths 120 and 122 to prevent lateral movements of the struts 56 and 58. It should be noted that all stationary components of the hitch, such as pivot mount assemblies 18, lock blocks 70, release mechanisms 84, anchors 78 and 80, safety flag covers 76, and the retarder cylinder assembly 30, are secured, such as by welding, to the surface of the deck 16.

The range of movement of the locking hook assembly 28 with respect to the lock blocks 70 and the anchors 78 and 80 is shown in FIG. 4, wherein the locking hook assembly 28 is shown in its non-engaging position. The arrowheads extending from the hooks 62 and 64 indicate the path of travel from the non-engaging position to a locking position with the lock blocks 70 and the movement of the pivot shaft 116 from non-engagement position to a stopping position with the anchors 78 and 80.

As various changes could be made in the above construction, without departing from the scope of the invention, it is intended that all matter contained in the above description or shown in the accompanying drawings shall be interpreted as illustrative and not in a limiting sense.

What is claimed is:

1. A collapsible load supporting apparatus comprising a vertically extending support having an upper end coupled to a plate adapted to support a load, first pivotable means securing a lower end of said vertically extending support, a diagonally extending support having an upper end pivotally secured to said vertically extending support adjacent the upper end thereof, locking hook assembly coupled by second pivotable means to a lower end of said diagonally extending support, anchor means for limiting the movement of said second pivotable means during erection of said apparatus, locking means engageable by said locking hook assembly for locking said vertically extending support in erected load supporting position, said anchor means and said locking means defining therebetween path means for reciprocable movement of said lower end of said diagonally extending support, release means secured adjacent said locking means and cooperatively engageable with said locking hook assembly for collapsing said load supporting apparatus, and retarding means coupled to said locking hook assembly for retarding the collapse of said apparatus, wherein said locking means comprises a pair of spaced lock blocks rigidly secured with respect to each other and defining a space therebetween, said anchor means comprising a pair of spaced anchor members rigidly secured with respect to each other and positioned in the space defined by said spaced lock blocks, each lock block and adjoining anchor member defining a path therebetween, said diagonally extending support comprising a pair of spaced strut members having predetermined ends for movement along the paths defined between the lock blocks and the anchors, each lock block and adjoining anchor member further acting as guide means for movement of said predetermined ends therebetween.

2. The apparatus according to claim 1, wherein said vertically extending support comprises a pair of spaced longitudinal members having lower ends secured to said first pivotable means, said diagonally extending support comprising a pair of spaced longitudinal members having upper ends pivotally secured between the spaced longitudinal members of said vertically extending support.

3. The apparatus according to claim 1, wherein said locking hook assembly comprises a pair of spaced hooks connected by a transverse member pivotally connected to said retarding means, said second pivotal means being in the form of a pivot shaft pivotably connecting said locking hook assembly, said pivot shaft passing through a bore in said lower end of said diagonally extending support and through bores in said spaced hooks.

4. The apparatus according to claim wherein the locking hook assembly comprises a pair of spaced hooks interconnected by a bracket, each of the hooks having an exterior side provided with a lateral protuburance defining a flag, said locking means comprises a pair of spaced lock blocks rigidly secured with respect to each other, each lock block being associated with a respective hook, a flag cover secured adjacent each of said lock blocks and adapted to obscure said flag, said flag being brilliantly colored, whereby said hooks, when not properly engaged with the lock blocks, will give a visible indication of improper erection of the apparatus.

5. The apparatus according to claim 1, wherein the locking means comprise a pair of spaced lock blocks rigidly secured with respect to each other, each of the blocks having an upper surface provided with a slope, said locking hook assembly comprising a pair of spaced hooks rigidly secured to each other by a bracket, said hooks having mounting bores traversed by a common pivot shaft, a free end of each hook having a sloping tooth adapted to glide across an upper surface of the respective lock block, said release mechanism being located adjacent each tooth engaged with the lock block, said release mechanism comprising a pivot block supporting pivotally a release lever, one end of said release lever being positionable below the tooth of the hook, and: the other end of the release lever having a bracket to be engaged by an insertable release bar, and a cover protecting the engageable end of said of releasable lever, whereby application of a force to the engageable end of the release lever will upset the tooth from engagement with its respective lock block thereby collapsing the apparatus.

6. Apparatus according to claim 1, wherein the vertically extending support comprises a pair of longitudinal spaced struts interconnected laterally by transverse members which are integral with the struts, said diagonally extending support comprising a pair of longitudinally extending spaced struts interconnected by laterally extending transverse members, the struts and the transverse members of each of the supports defining an integral unit.

7. Apparatus according to claim 1, wherein the locking hook assembly comprises a pair of spaced hooks interconnected by a bracket, including a torsion member for biasing said hooks into engagement with the locking means.

8. A collapsible load supporting apparatus adapted to be secured to a deck of a transport carrier, comprising a vertically extending strut assembly having an upper end adapted to support a load, a first pivotable means adapted to be rigidly secured to the deck and securing a lower end of said vertical strut assembly, a diagonally extending strut assembly having an upper end pivotally secured to said vertically extending strut assembly adjacent the upper end thereof, a locking hook assembly connected by a second pivotal means to a lower end of said diagonally extending strut assembly, spaced locking means adapted to be rigidly secured to said deck and engageable by said locking hook assembly for locking said vertically extending strut in an erected load supporting position, said spaced locking means defining a space therebetween, spaced anchor means for limiting the movement of said second pivotable means during erection of said apparatus, said anchor means comprising a pair of spaced anchor members rigidly secured with respect to each other and positioned in the space defined by said spaced locking means, said anchor means and said locking means defining therebetween a path for reciprocal movement of said lower end of said diagonally extending strut assembly, each locking means and adjoining anchor member further acting as guide means for movement of said lower end therebetween, release means disposed on either side of said locking means and rigidly secured to said deck and cooperatively engageable with said locking hook assembly for collapsing said load supporting apparatus, and retarding means secured to the deck and coupled to said locking hook assembly for retarding the collapse of said apparatus.

* * * * *